US005513418A

United States Patent [19]

Weber

[11] Patent Number: 5,513,418

[45] Date of Patent: May 7, 1996

[54] SUCTION NOZZLE WITH DUCTING

[75] Inventor: Vincent L. Weber, North Lawrence, Ohio

[73] Assignee: The Hoover Company, North Canton, Ohio

[21] Appl. No.: 265,947

[22] Filed: Jun. 27, 1994

[51] Int. Cl.[6] ..... A47L 5/30

[52] U.S. Cl. ..... 15/383; 15/415.1

[58] Field of Search ..... 15/383, 366, 384, 15/368, 415.1

[56] References Cited

U.S. PATENT DOCUMENTS

| | | | |
|---|---|---|---|
| Re. 15,423 | 7/1922 | Orr . | |
| 573,554 | 12/1896 | Stump . | |
| 1,260,547 | 3/1918 | Kern, Jr. . | |
| 1,268,963 | 6/1918 | Gray | 15/384 X |
| 1,355,553 | 12/1920 | Goughnour . | |
| 1,476,004 | 12/1923 | Orr . | |
| 1,782,882 | 11/1930 | Rippey . | |
| 1,849,218 | 3/1932 | Beach . | |
| 2,017,893 | 10/1935 | Boettler . | |
| 2,205,249 | 6/1940 | Fitzgerald et al. | 15/50 |
| 3,460,188 | 8/1969 | Boyd | 15/364 |
| 4,178,653 | 1/1978 | Tschudy | 15/383 |
| 4,426,751 | 1/1984 | Nordeen | 15/384 |
| 4,817,233 | 4/1989 | Waldhauser | 15/322 X |
| 5,018,240 | 5/1991 | Holman | 15/384 X |
| 5,077,862 | 1/1992 | Rench | 15/384 |

*Primary Examiner*—Chris K. Moore

[57] ABSTRACT

A vacuum cleaner suction nozzle having a rotating agitator is provided with at least a rearward suction duct extending transversely along the nozzle and having a bottom side serving as the rear lip of the nozzle. A forward suction duct may also be included in a similar configuration and have a bottom side formed by a front lip of the nozzle. The rear and/or forward suction ducts may also include a constant velocity attribute by increasing in size from their entrant ends to their discharge ends.

23 Claims, 6 Drawing Sheets

SUCTION NOZZLE WITH DUCTING

BACKGROUND OF THE INVENTION

1. Field of the Invention

This invention relates to floor care appliances and, more specifically, relates to a suction nozzle and its ducting for such a floor care product.

2. Summary of the Prior Art

Notably improving the cleaning efficiency of vacuum cleaners may involve improved motor or fan design, improved agitator configurations or perhaps, more significantly, improved nozzle design. However, heightened nozzle based cleaning efficiency in today's marketplace is dependent, generally, on certain fixed parameters such as the relatively standardized use of the fan suction ducting being confluently connected to the suction nozzle at its side. Thus, adaption of any nozzle structural improvements must take into accord its potential for use with a side ducted nozzle even though it might also find practical use in a center feed nozzle.

Accordingly, it is an object of the invention to provide an improved nozzle structure which materially contributes to enhanced cleaning efficiency.

It is a further object of the invention to utilize a lip of the suction nozzle as a component of the suction ducting.

It is a still further object of the invention to extend the suction duct transversely along a substantial length of the nozzle lip.

It is an additional object of the invention to provide a suction duct, partly formed by nozzle lip, that extends the length of the nozzle for final communication with a sidewardly disposed main suction duct.

It is an even further object of the invention to provide a nozzle duct with a constant velocity characteristic.

It is also an object of the invention to provide both forward and rearward ducts or a forward or rearward duct extending along a suction nozzle.

SUMMARY OF THE INVENTION

The invention is provided in a side ducted nozzle having front and back transversely extending nozzle lips. One or both of these lips may serve as the bottom side of a sidewardly extending duct or ducts that extend along the nozzle to communicate with the nozzle side duct. A duct slot is provided for a sidewardly extending duct by making the duct contiguous vertical wall facing the interior of the nozzle slightly shorter than the other duct vertical wall so that it terminates short of its respective nozzle lip and provides an entrance slot for suction air. The duct or ducts are provided with a larger and larger proportional volume as each approaches the side duct to provide a substantially constant carrying velocity to the suction air stream within these sidewardly extending ducts. A standard, rotating agitator is included in the suction nozzle which, because of its direction of rotation, is thought to pick up and toss dirt over and on the lip of the rear sidewardly extending duct, if present, where it is, in a sense, trapped and then immediately transported along this duct to be discharged directly into the side duct. The lip of a front duct would impingingly receive dirt carried around by the agitator and discharge towards it where it would also be trapped for transport along the sidewardly extending front duct to the side duct. Another explanation for the efficiency of the nozzle lip sidewardly extending duct, perhaps, is that the configuration of agitator and nozzle ducting provides both brush tuft and air movement for dirt transport in the same direction until dirt is nozzle duct contained for eventual discharge to a rearwardly extending duct.

BRIEF DESCRIPTION OF THE DRAWINGS

Reference now may be had to the accompanying Drawings for a better understanding of the invention, both as to its organization and function, with the illustration being of a pair of embodiments, but being only exemplary, and in which.

DETAILED DESCRIPTION OF THE DRAWINGS

Figure 1:
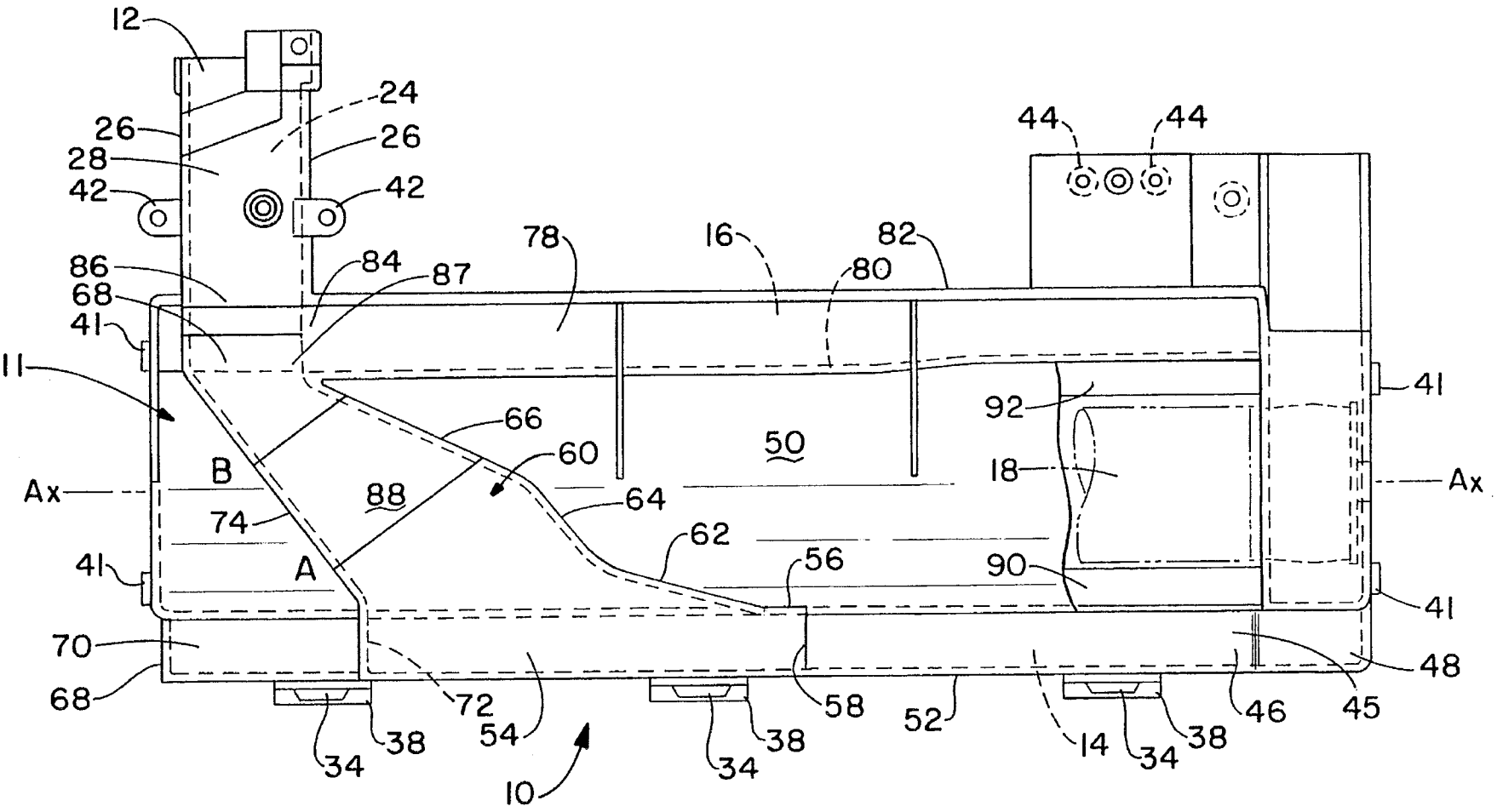
FIG. 1 is a top plan view showing the preferred two duct nozzle arrangement.
Figure 2:
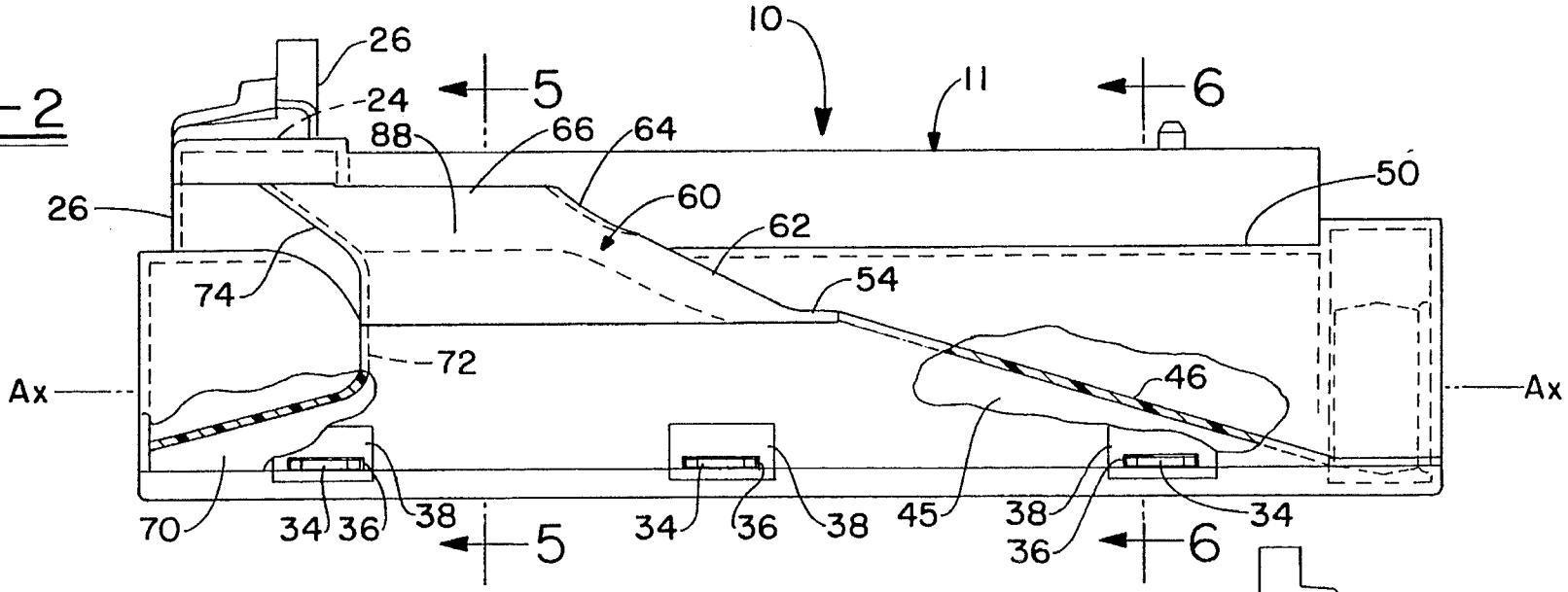
FIG. 2 is a front elevational view, partly in section, of the nozzle of FIG. 1 showing the front duct.
Figure 3:
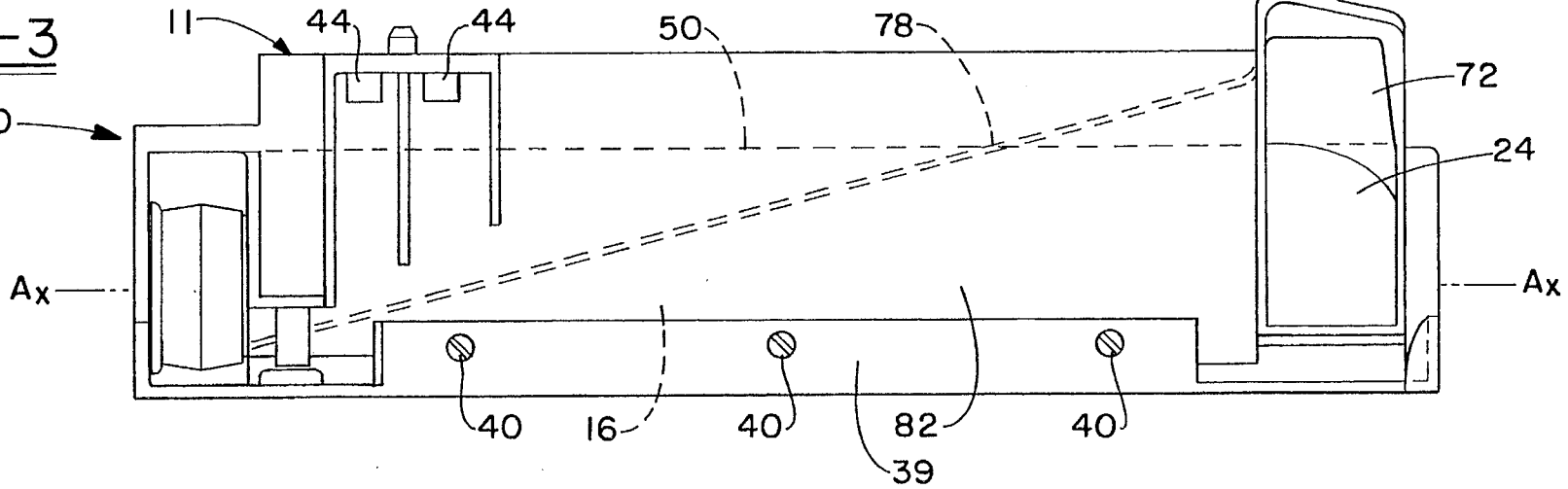
FIG. 3 is a rear elevational view of the nozzle of FIG. 1 and showing the rear duct.
Figure 4:
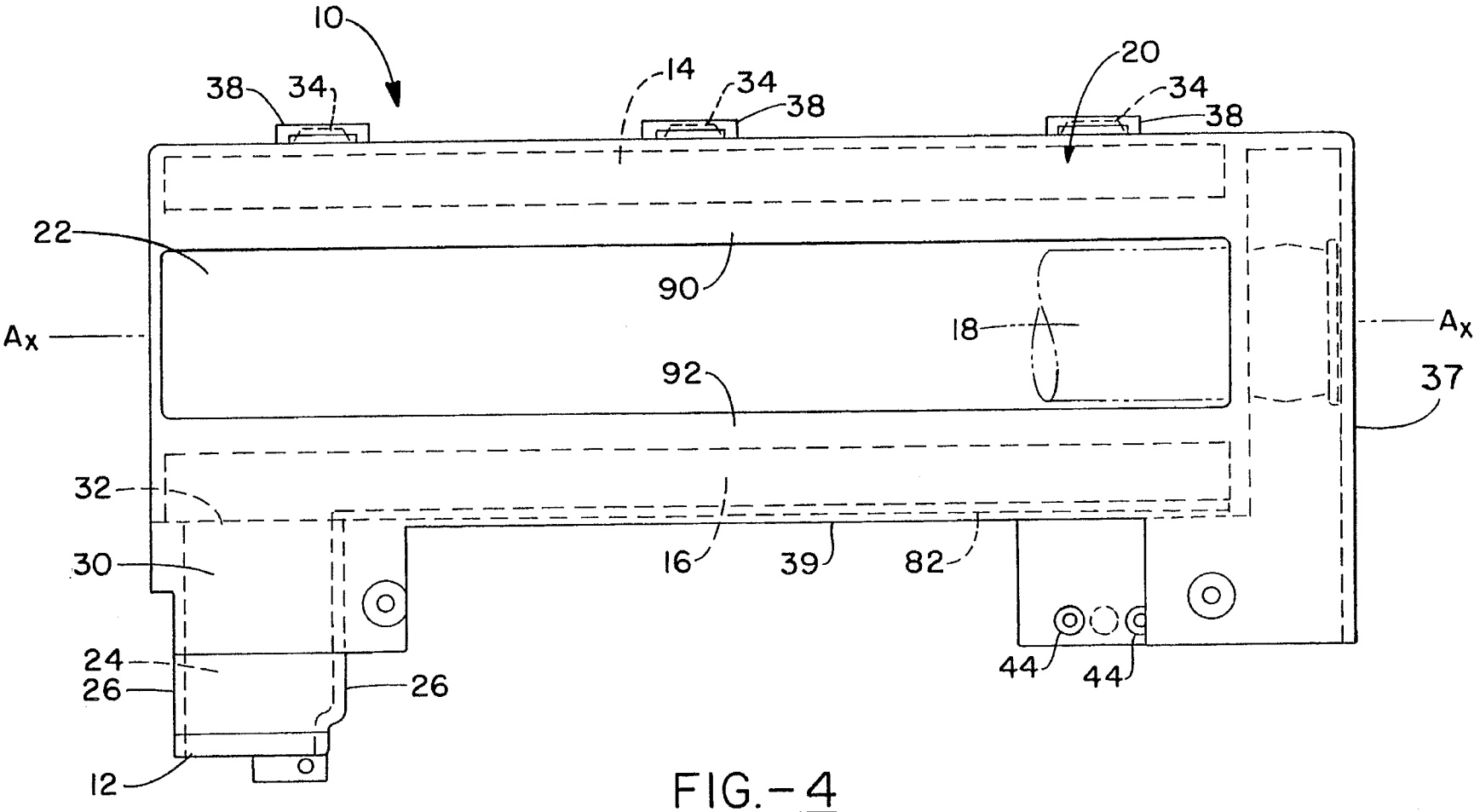
FIG. 4 is a bottom plan view of the nozzle and ducting of FIG. 1.

There is shown in FIGS. 1–8, a nozzle 10 having a nozzle body 11 including a connected rearwardly extending side discharge duct 12 which leads conventionally to a motor-fan system (not shown) and a pair of integral front and rear sidewardly extending ducts 14, 16, respectively and a rotatable agitation 18 disposed within the nozzle body 11. A bottom plate 20 covers the bottom side of the nozzle body 11 and includes a suction slot 22 on which the agitator 18 is centered so as to be in surface engaging contact with the surface on which nozzle 10 rests.

The rear discharge duct 12 includes a suction passageway 24 and extends juttingly rearwardly out of the nozzle body 11 to provide communication with the conventional motor-fan system (not shown) disposed downstream of nozzle 10. This duct is formed with vertical walls 26, 26 and top and bottom horizontal walls 28 and 30 to provide a vertically elongated, rectangular shape to suction passageway 24. This passageway, at its front, opens confluently at opening 32 to front and rear sidewardly extending ducts 14, 16, respectively.

Bottom plate 20 of nozzle 10 is illustrated substantially coextensive with the bottom outline of the nozzle body 11 and includes integral front outwardly extending spaced tabs 34, 34, 34 that engage outwardly into slots 36, 36, 36 in outwardly stepped and downwardly depending tabs 38, 38, 38, formed integral with the nozzle body 11. A rear side wall 39 of the bottom plate 20 is attached to the nozzle body by a series of screws 40, 40, 40. Each of the ends 37, 37 of the bottom plate 20 is attached to nozzle body 11 by a series of vertically extending tabs 41, 41, screwingly attached to both. The bottom plate 20, insofar as its connection to nozzle body 11 is, as described, in this inventive embodiment. However, in production it is contemplated that the rear portions of bottom plate 20 be shaped like and connected to the wheeled main suction body (not shown) as taught in U.S. Pat. No. 4,151,628, issued May 1, 1979 and owned by a common assignee.

The nozzle body 11, as illustrated, also includes as exemplary, a series of bored bosses such as bored bosses 42, 42, located at the rear discharge duct 12, and bored bosses 44, 44 located at the opposite end of the nozzle body 11. These bosses provide for rivet connection (not shown) to the wheeled main suction body (not shown) of which nozzle 10 is a part. This sort of arrangement is shown generally in U.S. Pat. No. 4,171,554, issued Oct. 23, 1979 and owned by a common assignee.

The manner of attaching the bottom plate 20 to the nozzle body 11 and of attaching the nozzle body 11 to a wheeled main suction body (not shown) is not a part of this invention so no further explanation of this structure will be here given.

The front sidewardly extending duct 14 is shaped to provide, as closely as possible, a constant air carrying velocity along it until its discharge into rear discharge duct 12 by constantly and uniformly expanding along its length. It includes an integral upwardly angled duct section 45 including a top wall 46 extending from adjacent an end 48 of nozzle body 11 remote from rear discharge duct 12. Top wall 46 is angled uniformly upwardly from this end to approximately midway of the nozzle body 11. It attaches, along its length, integrally to a vertical wall portion 49 of a partially cylindrical section 50 of nozzle body 11 that houses agitator 18. Since the top wall 46 is angularly disposed until its inward termination, vertical wall portion 49 is triangularly shaped in plan. The front sidewardly extending duct 14 also includes, in the angled duct section 45 of duct 14, a front wall 52, parallel to vertical wall portion 49 and similarly shaped which provides a completion of the angled duct suction 45 except for the relationship of the bottom plate 20 to it and the front sidewardly extending duct 14 which will be described later.

Air moving through the angled duct section 45 of front duct 14 enters a transition section 54 of the duct that passes over a bottom face wall 55 formed by the top of partially cylindrical section 50 of nozzle body 11 to confluently communicate with rear discharge duct 12. Transition section 54, adjacent the inward termination 58 of duct section 45, includes a short adjoining portion 56 that communicates directly with the terminating end 58 of duct section 45 and is of the same height as this termination. It, thereby, provides no expanding duct portion for maintaining constant air velocity but is necessary for easy moldability to the front duct 14 and nozzle body 11. Ideally, it is as illustrated, shortened and abbreviated so it does not seriously effect the constant carrying velocity of suction air passing through front duct 14.

Short adjoining portion 56 merges into an expanding duct portion 60 which includes a forward lead in wall 62. This lead in wall is slightly angled relative to adjoining portion 56 upwardly over cylindrical portion 50 to provide a smoothed airflow with front duct 14. It merges with a more steeply angled wall 64 but which is deeper and provides a transition into an angled wall piece 66. Angled wall piece 66 terminates, slightly spaced from the front suction opening 32 of rear discharge duct 12.

An opposite end 68 of front duct 14 is formed with a short angled duct portion 70 like duct portion 45 that angles upwardly along nozzle body 12 towards expanding duct portion 60. This short angled duct, again because of its expanding characteristics, provides a constant transport velocity characteristic to the suction air moving through it. It terminates in a vertically extending wall 72 extending upwardly vertically and outwardly from it along cylindrical portion 50 and forming a portion of the other wall of expanding duct portion 60. This wall merges into an angularly extending wall 74 also extending along cylindrical portion 50 till it terminates adjacent opening 32 in wall portion 75.

The walls 62, 64, 66, 72 and 74 of expanding duct portion 60 are, along their top sides angled relative to the horizontal so that their wall heights provide a suction airflow path within expanding duct portion 60 which is made, as far as possible, constant in cross-sectional area such as at section A—A or B—B. For example, these two cross sections were designed to have the same cross section as the total sum of largest cross sections of the duct sections 45 and 70. This aids in promoting a constant transport velocity through front duct 14 and expanding duct portion 60 insofar as practicable.

Rear duct 16 extends along a rear side 76 of nozzle body 11 in an expanding way. It includes upwardly angled top wall 78, a generally integral upwardly angled forward wall 80 a portion of which is formed by the external surface of cylinder portion 50 and a portion on vertical extension 81 and a rear vertically extending reinforcing wall 82. This wall joins integrally to upwardly angled top wall 78 and extends thereabove to be generally aligned with the top side of rear discharge duct 12. It forms the rear side of the nozzle body 11 at its bottom. The rear duct 16 terminates in a discharge opening 84 which is as deep in height as the actual rear discharge duct 12 at its suction opening 86 to confluently connect thereto. A suction opening 87 of forward duct 14 is also in confluent communication with these two openings and is essentially located flush with forward wall 80 of rear duct 16.

The expanding duct portion 60, because of molding requirement ease, is formed without a top wall so that a top wall 88 of the exact top outline and vertical terminating shape of expanding duct portion 60 is mounted thereon by gluing or the like to complete the closed volume of the forward duct 14.

The bottom side of forward and rearward ducts 14, 16, respectively, include bottom sides 90, 92, formed by the forward and rearward suction lips on the bottom plate 20. These lips border the agitator opening or suction slot 22 at its forward and rearward sides end extend for the full length of the front and rear ducts 14, 16.

Figure 6:
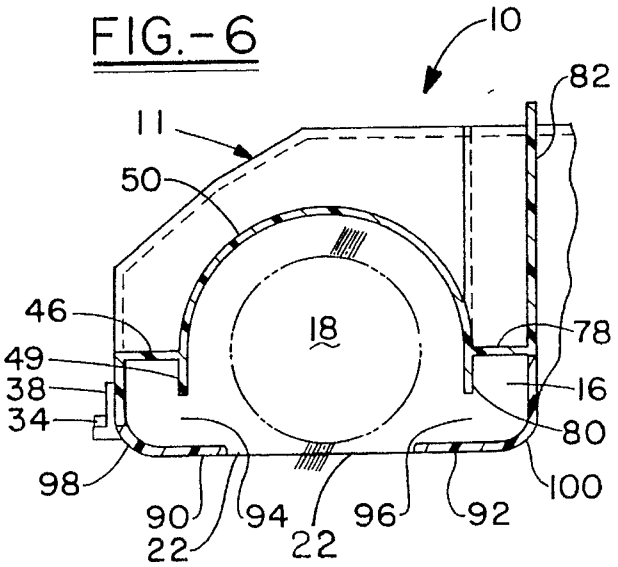
FIG. 6 is a cross-sectional view of the nozzle of the preferred embodiment taken on line 6—6 of FIG. 2.
Figure 5:
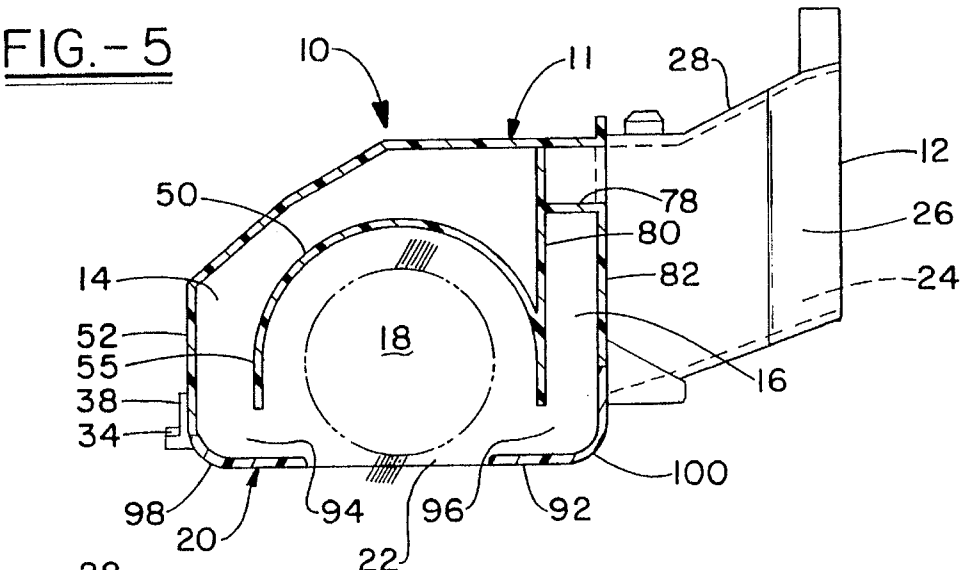
FIG. 5 is a cross-sectional view of the nozzle of the preferred embodiment taken on line 5—5 of FIG. 2.
Figure 8:
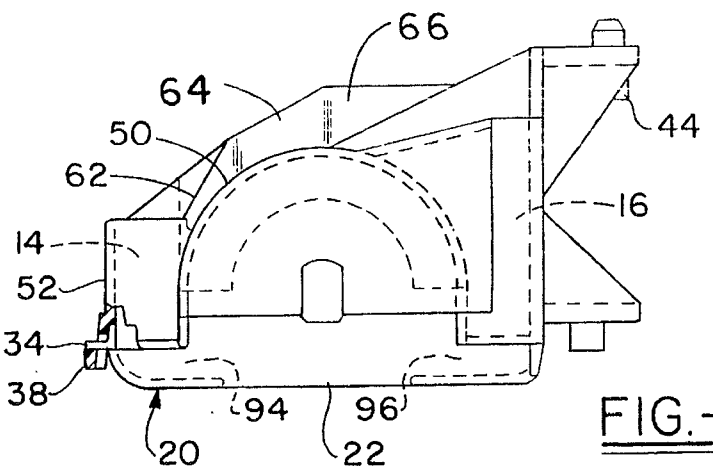
FIG. 8 is a right hand end embodiment view of the nozzle body of FIG. 1.
Figure 7:
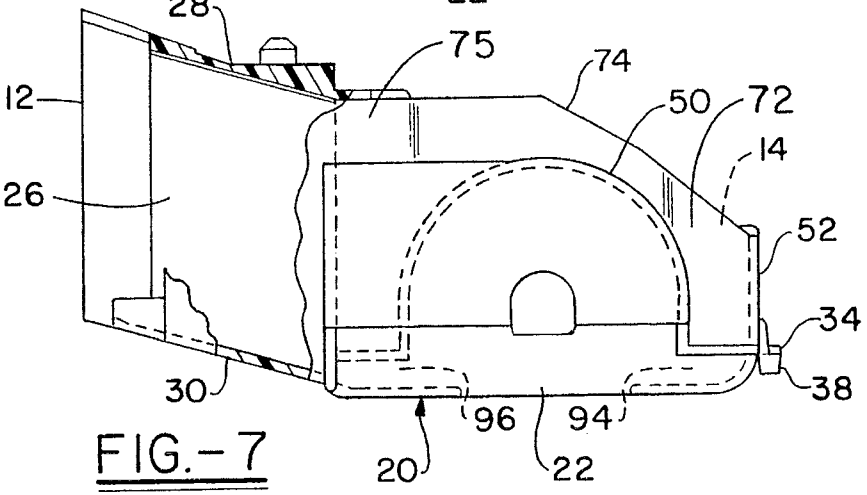
FIG. 7 is a left hand end elevational view of the nozzle body of FIG. 1.

As can be seen in FIGS. 5 and 6, these lips extend beyond the inner vertical walls 49, 80 of the forward and rearward ducts. As is also seen in these two views, these two lips are also spaced vertically from the inner walls of ducts 14 and 16 to provide entrance slots 94, 96 for the inflow of suction air. Since the lips 90, 92 spacedly overlap the inner duct vertical walls they provide ideal impingement and lodgement surfaces for dirt drivingly moved within the nozzle body 11 by agitator 18.

Figure 9:
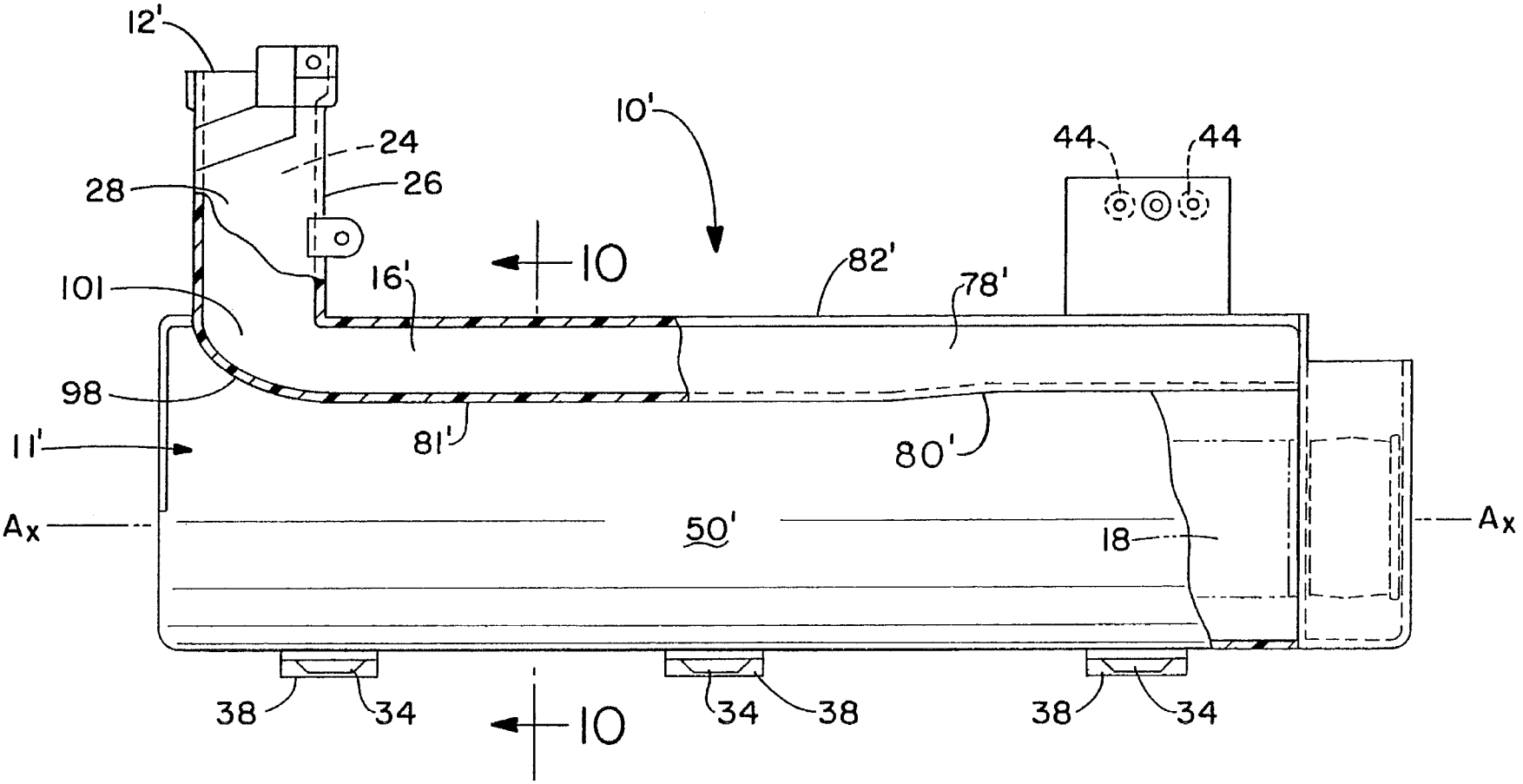
FIG. 9 is a top plan view of a second embodiment of the invention having only a rearward sidewardly extending duct.
Figure 10:
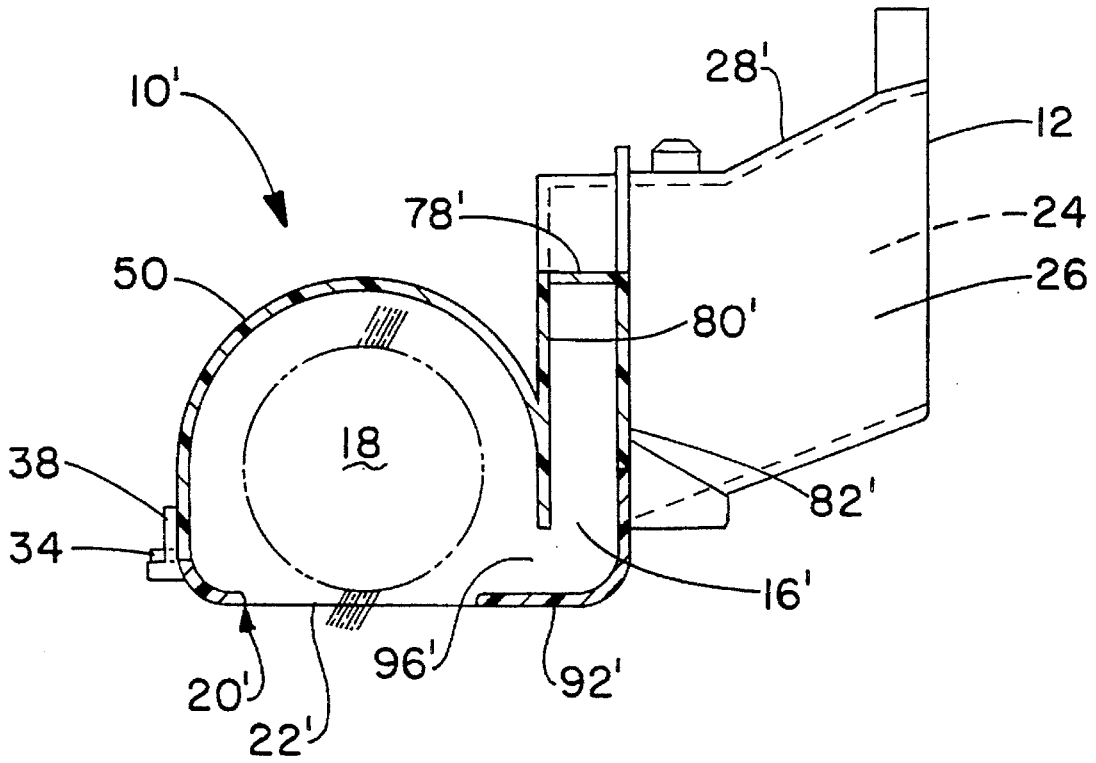
FIG. 10 is a cross-sectional view of the nozzle of FIG. 9 taken on line 10—10 of FIG. 9.

There is shown in FIGS. 9 and 10, a second embodiment of the invention. In this second embodiment like elements as in the first embodiment carry the same reference characters and changed elements are primed.

A suction nozzle 10' including a rotatable agitator 18 and a nozzle body 11' is provided in which only a single sidewardly extending duct, but one in accordance with the principles of the invention. A rearward duct 16' is expandingly angled upwardly along the rear side of nozzle body 11' as is the rearward duct 16 in the first embodiment. This provides a more constant air velocity for dirt carry through.

Rearward duct 16' includes an upwardly angled top wall 78', a rear wall 82' formed as a reinforcing wall for the nozzle body 11' and a front wall 80 formed in part by cylindrical portion 50 of nozzle body 11' and partly by a vertical extension 81' of it. A lip 92' on bottom plate 20' forms the bottom side of the duct 16' with a slot 96' formed by the spacing of the lip 92' communicating with the interior of the nozzle body 11'.

Since there is only one sidewardly extending duct in this embodiment of the invention, it is led directly into the rearwardly extending duct 12 by a vertically curved wall section 98 that forms a continuation of wall section 81' and joins sealingly with rear duct 12. This curved wall section is generally of the same height as rear duct 14' at this location so that it properly mates with rear duct opening 86. The angularly disposed top wall 78' of rear duct 16 also includes a curved portion 100 that insures the sealing integrity of the rear duct 16' at this location.

It should now be clear that the advantages set out at the beginning of the description of the invention have been fully satisfied by the structure disclosed. It should also be obvious that many modifications could be made to this structure which would still fall within its spirit or purview. For example, only a single sidewardly extruding duct could be used but on the front side of the nozzle body.

What is claimed is:

1. A suction nozzle having a rear discharge duct including:

a) a nozzle body;

b) a sidewardly extending duct communicating with said rear discharge duct;

c) said sidewardly extending duct being disposed to extend transversely along said nozzle body;

d) said sidewardly extending duct including a bottom wall;

e) said bottom wall forming a nozzle supporting lip;

f) said sidewardly extending duct also including a pair of vertically extending walls;

g) one of said vertically extending walls being spaced from said supporting lip to provide an open slot for air and dirt impingement on said nozzle supporting lip and transport along said sidewardly extending duct; and h) said sidewardly extending duct providing a constant air flow velocity characteristic by expanding in cross-section area along said nozzle body toward said rear discharge duct.

2. A suction nozzle having a rear discharge duct as set out in claim 1 wherein:

a) said sidewardly extending duct is disposed along the rear side of said nozzle body.

3. A suction nozzle having a rear discharge duct as set out in claim 2 wherein:

a) said sidewardly extending duct at the front of said nozzle body includes a communicating portion that extends over said duct body to fluidly communicate with said rear discharge duct.

4. A suction nozzle having a rear discharge duct as set out in claim 3 wherein:

a) said communicating portion is generally provided with constant cross-sectional areas to improve air carrying velocity.

5. A suction nozzle having a rear discharge duct as set out in claim 1 wherein:

a) said sidewardly extending duct is disposed along the rear side of said nozzle body.

6. A suction nozzle having a rear discharge duct as set out in claim 1 wherein:

a) only one sidewardly extending duct is provided.

7. A suction nozzle having a rear discharge duct as set out in claim 1 wherein:

a) sidewardly extending ducts are provided along both the front and rear sides of said nozzle body.

8. A suction nozzle having a rear discharge duct as set out in claim 7 wherein:

a) said sidewardly extending duct at the front of said nozzle body includes a communicating portion that extends over said duct body to fluidly communicate with said rear discharge duct.

9. A suction nozzle having a rear discharge duct as set out in claim 1 wherein:

a) said supporting lip extends inwardly of said vertically extending spaced wall relative to said suctional nozzle.

10. A suction nozzle having a rear discharge duct including:

a) a nozzle body;

b) a sidewardly extending duct communicating with said rear discharge duct;

c) said sidewardly extending duct being disposed to extend transversely along said nozzle body;

d) said sidewardly extending duct including a pair of vertically extending walls;

e) an agitator disposed in said nozzle body; and f) said duct having a bottom wall forming a substantially continuously flat, horizontally extending bottom support lip for said suction nozzle.

11. The suction nozzle having a rear discharge duct as set out in claim 12 wherein:

a) said sidewardly extending duct provides a constant air velocity characteristic by expanding in cross-sectional area along said nozzle body towards said rear discharge duct.

12. A suction nozzle having a rear discharge duct including:

a) a nozzle body;

b) a sidewardly extending duct communicating with said rear discharge duct;

c) said sidewardly extending duct being disposed to extend transversely along said nozzle body;

d) said sidewardly extending duct including a pair of vertically extending walls;

e) an agitator disposed in said nozzle body; and f) said sidewardly extending duct being disposed along the front side of said nozzle body.

13. A suction nozzle having a rear discharge duct as set out in claim 10 wherein:

a) said sidewardly extending duct is disposed along the rear side of said nozzle body.

14. A suction nozzle having a rear discharge duct as set out in claim 13 wherein:

a) only one sidewardly extending duct is provided.

15. A suction nozzle having a rear discharge duct including:

a) a nozzle body;

b) a sidewardly extending duct communicating with said rear discharge duct;

c) said sidewardly extending duct being disposed to extend transversely along said nozzle body;

d) said sidewardly extending duct including a pair of vertically extending walls;

e) an agitator disposed in said nozzle body; and f) said sidewardly extending duct being paired to provide a duct along both the front and rear sides of said nozzle body.

16. A suction nozzle having a rear discharge duct as set out in claim 12 wherein:

a) said sidewardly extending duct at the front of said nozzle body includes a communicating portion that extends over said duct body to fluidly communicate with said rear discharge duct.

17. A suction nozzle having a rear discharge duct as set out in claim 15 wherein:

a) said sidewardly extending duct at the front of said nozzle body includes a communicating portion that extends over said duct body to fluidly communicate with said rear discharge duct.

18. A suction nozzle having a rear discharge duct including:

a) a nozzle body;

b) a pair of sidewardly extending ducts communicating with said rear discharge duct;

c) said sidewardly extending ducts being disposed to extend transversely along said nozzle body; and d) said sidewardly extending ducts being disposed on the front and rear sides of said nozzle body.

19. A suction nozzle having a rear discharge duct as set out in claim 1 wherein:

a) said nozzle body mounts an agitator therein.

20. The suction nozzle having a rear discharge duct as set out in claim 12 wherein:

a) said vertically extending walls include an inner wall and an outer wall; and b) said bottom wall extends inwardly of said inner wall relative to said suction nozzle from said outer wall.

21. The suction nozzle having a rear discharge duct as set forth in claim 15 wherein:

a) each of said ducts includes a bottom wall attached to one of said vertically extending walls and offset vertically from the other.

22. The suction nozzle having a rear discharge duct as set out in claim 18 wherein:

a) said front sidewardly extending duct includes pair of front and rear substantially vertically extending walls;

b) said rearward sidewardly extending ducts also includes a pair of substantially vertically extending front and rear walls;

c) said front wall of said front duct is at least partly formed by a front wall of said suction nozzle; and d) said rear wall of said rear duct is at least partly formed by a rear wall of said suction nozzle.

23. The suction nozzle having a rear discharge duct as set out in claim 22 wherein:

a) each of said front wall of said front duct and said rear wall of said rear duct include a generally horizontal inwardly extending nozzle support lip so that said front and rear ducts include a bottom side;

b) said nozzle lip on said front duct extends inwardly relative to said suction nozzle beyond said rear wall of said front duct; and c) said nozzle lip on said rear duct extends inwardly relative to said suction nozzle beyond said front wall of said rear duct;

d) whereby each of said ducts is provided with a bottom side that acts an impingement area for said suction nozzle.

* * * * *

UNITED STATES PATENT AND TRADEMARK OFFICE

CERTIFICATE OF CORRECTION

PATENT NO. : 5,513,418

DATED : May 7, 1996

INVENTOR(S) : Vincent L. Weber

It is certified that error appears in the above-indentified patent and that said Letters Patent is hereby corrected as shown below:

Claims 2-7 should read:

2. A suction nozzle having a rear discharge duct as set out in claim 1 wherein:
   a) said sidewardly extending duct is disposed along the front side of said nozzle body.
3. A suction nozzle having a rear discharge duct as set out in claim 1 wherein:
   a) said sidewardly extending duct is disposed along the rear side of said nozzle.
4. A suction nozzle having a rear discharge duct as set out in claim 3 wherein:
   a) only one sidewardly extending duct is provided.
5. A suction nozzle having a rear discharge duct as set out in claim 1 wherein:
   a) sidewardly extending ducts are provided along both the front and rear sides of said nozzle body.
6. A suction nozzle having a rear discharge duct as set out in claim 2 wherein:
   a) said sidewardly ~~extending~~ duct at the front of said nozzle body includes a communicating portion that extends over said duct body to fluidly communicate with said rear discharge duct.

UNITED STATES PATENT AND TRADEMARK OFFICE

CERTIFICATE OF CORRECTION

PATENT NO. : 5,513,418

DATED : May 7, 1996

INVENTOR(S) : Vincent L. Weber

It is certified that error appears in the above-indentified patent and that said Letters Patent is hereby corrected as shown below:

7. A suction nozzle having a rear discharge duct as set out in claim 5 wherein:

a) said sidewardly extending duct at the front of said nozzle body includes a communicating portion that extends over said duct body to fluidly communicate with said rear discharge duct.

Signed and Sealed this

Eighteenth Day of February, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,513,418

DATED : May 7, 1996

INVENTOR(S) :

Vincent L. Weber

It is certified that error appears in the above-identified patent and that said Letters Patent is hereby corrected as shown below:

Claim 11 should depend from claim 10.
As such, claim 11 should read:

11. The suction nozzle having a rear discharge duct as set forth in claim 10 wherein:
    a) said sidewardly extending duct provides a constant air velocity characteristic by expanding in cross-sectional area along said nozzle body toward said rear discharge duct.

Signed and Sealed this

Fourth Day of April, 2000

*Attest:*

Q. TODD DICKINSON

*Attesting Officer*

*Director of Patents and Trademarks*